US005140377A

United States Patent [19]

Lewis et al.

[11] Patent Number: 5,140,377

[45] Date of Patent: Aug. 18, 1992

[54] THERMAL FUSING OF TONER IN XEROGRAPHIC APPARATUS USING WATER VAPOR

[75] Inventors: Richard B. Lewis, Williamson; Michael J. Levy, Webster, both of N.Y.

[73] Assignee: Xerox Corporation, Stamford, Conn.

[21] Appl. No.: 797,675

[22] Filed: Nov. 25, 1991

[51] Int. Cl.[5] ..... G03G 15/20

[52] U.S. Cl. ..... 355/285; 355/292; 355/77; 430/124

[58] Field of Search ..... 355/285, 282, 77, 292; 430/33, 104, 124

[56] References Cited

U.S. PATENT DOCUMENTS

| | | | |
|---|---|---|---|
| 3,013,342 | 12/1961 | Huber et al. | 355/292 |
| 3,117,847 | 1/1964 | Norton | 355/292 |
| 3,792,488 | 2/1974 | Katakabe | 355/292 |
| 4,079,228 | 3/1978 | Moser | 355/292 |
| 4,538,899 | 9/1985 | Landa et al. | 355/292 |
| 5,014,090 | 5/1991 | Santilli | 355/256 |

FOREIGN PATENT DOCUMENTS

| | | | |
|---|---|---|---|
| 56-77872 | 6/1981 | Japan | 355/293 |
| 62-160476 | 7/1987 | Japan | 355/292 |

*Primary Examiner*—Richard L. Moses
*Attorney, Agent, or Firm*—R. Hutter

[57] ABSTRACT

In a xerographic printing apparatus, toner material is thermally fused and fixed onto a surface of a copy sheet by condensing water vapor on the surface of the copy sheet. In the preferred embodiment, the toner material substantially comprises docasanoic acid. The water vapor is condensed on the surface of the copy sheet by means of applying the water vapor onto the surface through a narrow slit moving relative to the surface.

18 Claims, 2 Drawing Sheets

THERMAL FUSING OF TONER IN XEROGRAPHIC APPARATUS USING WATER VAPOR

FIELD OF THE INVENTION

The present invention relates to a technique for fixing toner material onto a copy sheet as part of a xerographic printing process. Specifically, the invention relates to a step of fusing toner material by condensing water vapor on the surface of the copy sheet.

BACKGROUND OF THE INVENTION

In the process of xerography, a light image of an original to be copied is typically recorded in the form of a latent electrostatic image upon a photosensitive member. The latent image is then rendered visible by the application of electroscopic marking particles, commonly referred to as toner, to the photosensitive member. The visual image is then transferred from the photosensitive member to a sheet of plain paper with subsequent permanent bonding of the image thereto. This bonding of the toner particles onto the paper generally comprises two steps: fusing, in which the toner particles on the paper are partially melted, or otherwise made fluid; and fixing, in which the fluid toner particles are bonded to the paper. In general parlance, however, these two steps are conceptually combined (since, in many common techniques, the two steps occur substantially simultaneously), and the two steps are together known in the art simply as "fusing."

In order to fuse the image formed by the toner onto the paper, electrophotographic printers incorporate a device commonly called a fuser. While the fuser may take many forms, heat or combination heat-pressure fusers are currently most common. One combination heat-pressure fuser includes a heat fusing roll in physical contact with a relatively soft pressure roll. These rolls cooperate to form a fusing nip through which the copy sheet (the sheet on which the document is finally formed) passes.

Although hot-roll fusing is currently the most common method of fusing in commercially-available electrophotographic printing machines today, numerous other fusing techniques are well known in the art. Fusing by heat alone, by exposing the copy sheet to a heat source, was often used in early plain-paper copying machines. While the use of an electrical heating element by itself affords simplicity of design, it tends to be energy-inefficient, and may present a fire hazard if copy sheets are jammed in the fusing station. Another popular technique is flash fusing, in which a copy sheet is exposed to a quick and intense flash which heats only the top surface of the sheet, and more specifically, mainly the relatively dark areas of toner on the sheet. While flash fusing is efficient for directing light energy for the purpose of fusing, the equipment for creating the flashes tends to be expensive and energy-inefficient. Finally, another common technique is cold pressure roll fusing, in which no external source of heat is used, and the fusing and fixing is carried out by extremely high physical pressure on the sheet. This technique has the advantages of consuming little power, and not requiring any warmup time, but has the disadvantages of creating glossy images and providing a poor fix on solid areas of an image.

Another important technique for fusing is chemical vapor fusing. In this technique, toner on the surface of a copy sheet is made fluid by exposure to a gaseous solvent. Typically, a sheet to be fused is placed on a wireform tray and inserted into a chamber, where fumes evaporate from a wick soaked in solvent. Chemical vapor fusing is most often used in situations where high temperatures are to be avoided and thermal fusing would damage the copy sheet. The copier known under the trade name XEROX 6500, for example, includes a chemical vapor fusing system for use with transparencies. Recent prior art making use of chemical vapor fusing includes U.S. Pat. No. 5,014,090 to Santilli. However, many vapor solvents, such as halogenated hydrocarbons, will emit dangerous fumes or become explosive in a high-temperature environment.

No matter which type of fusing is used in an electrophotographic apparatus, fusing is one of the most constraining parameters in the design of any system. Heat-generating fusers consume from 55 to 70 percent of a machine's power during warmup, and require most of the warmup time. Cold roll fusers and flash fusers require large volumes of space in a machine. In hot roll or cold roll fusing, the dwell time of a copy sheet through the fuser is one of the most important limits to the speed of the machine. The fuser is often responsible for most of the environmental problems of a machine, such as noise, heat, and odor. Finally, the fusing step is one of the most crucial in regards to final copy quality. Improper fusing can cause smearing, lack of uniformity of an image, and/or unattractive mottled appearance to an image. For these reasons, designers of copying machines and printing systems require a great flexibility in selecting which type of fuser they wish to use.

It is an object of the present invention to provide a novel method for fusing in a xerographic system.

SUMMARY OF THE INVENTION

In a xerographic printing apparatus, toner material is thermally fused and fixed onto a surface of a copy sheet by condensing water vapor on the surface of the copy sheet. In the preferred embodiment, the toner material substantially comprises docosanoic acid. The water vapor is condensed on the surface of the copy sheet by means of applying the water vapor onto the surface through a narrow slit moving relative to the surface.

The method of the present invention is preferably carried out by a device including a support for the copy sheet, and a slit disposed adjacent the surface of the copy sheet. The slit moves relative to the copy sheet while water vapor is caused to pass through the slit toward the surface of the copy sheet.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
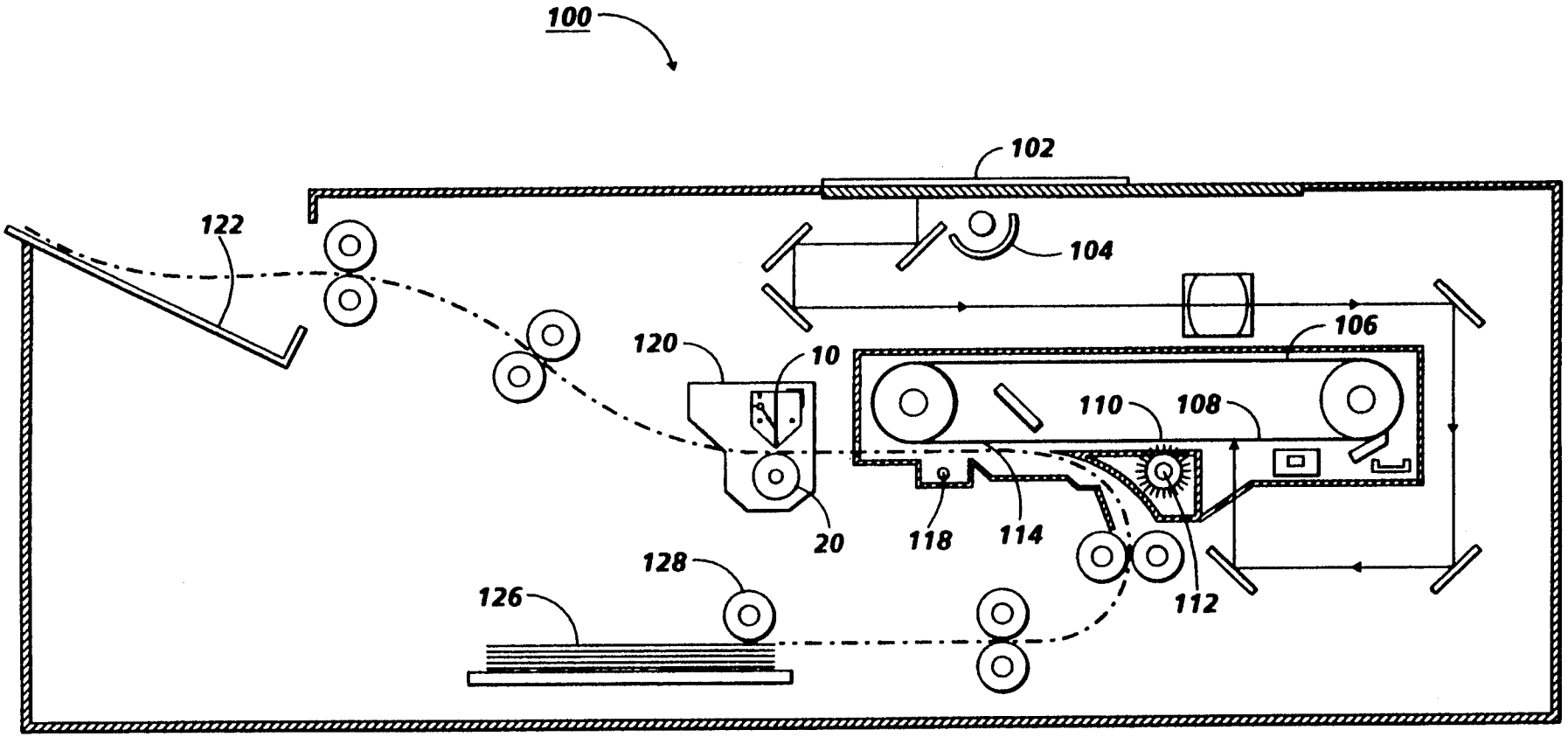
FIG. 1 is a simplified diagram showing the basic elements of a typical electrophotographic printer.

FIG. 1 shows the basic elements of a typical electrophotographic printer, in this case a photocopier 100. In photocopier 100, a document to be reproduced is placed on a platen 102 where it is illuminated in known manner by a light source such as a tungsten halogen lamp 104. The document thus exposed is imaged onto the photoreceptor belt 106 by a system of mirrors, as shown. The optical image selectively discharges the photoreceptor 106 in an image configuration whereby an electrostatic latent image of the original document is formed on the belt 106 at imaging station 108. The photoreceptor belt 106 then rotates so that the latent image is moved towards development station 110, where a magnetic brush developer system 112 develops the electrostatic latent image into visible form. At developer system 112, toner is dispensed from a hopper (not shown) and deposited in known manner, such as by magnetic brush development, on the charged area of photoreceptor belt 106 corresponding to the optical image to be reproduced.

The developed image is transferred at the transfer station 114 from the photoreceptor belt 106 to a sheet of copy paper, which is delivered from a paper supply system into contact with the belt 106 in synchronous relation to the image thereon. Individual sheets are introduced into the system from a stack of supply paper 126 by a friction feeder 128. A separated sheet from stack 126 is fed, in the embodiment shown, by further sets of nip roll pairs around a 180° path indicated by the broken line. At the transfer station 114, a transfer corotron 118 provides an electric field to assist in the transfer of the toner particles from the photoreceptor belt 106 to the copy sheet. The image is subsequently fused onto the paper in known manner at fusing station 120 and the finished copy is deposited in hopper 122.

Figure 2:
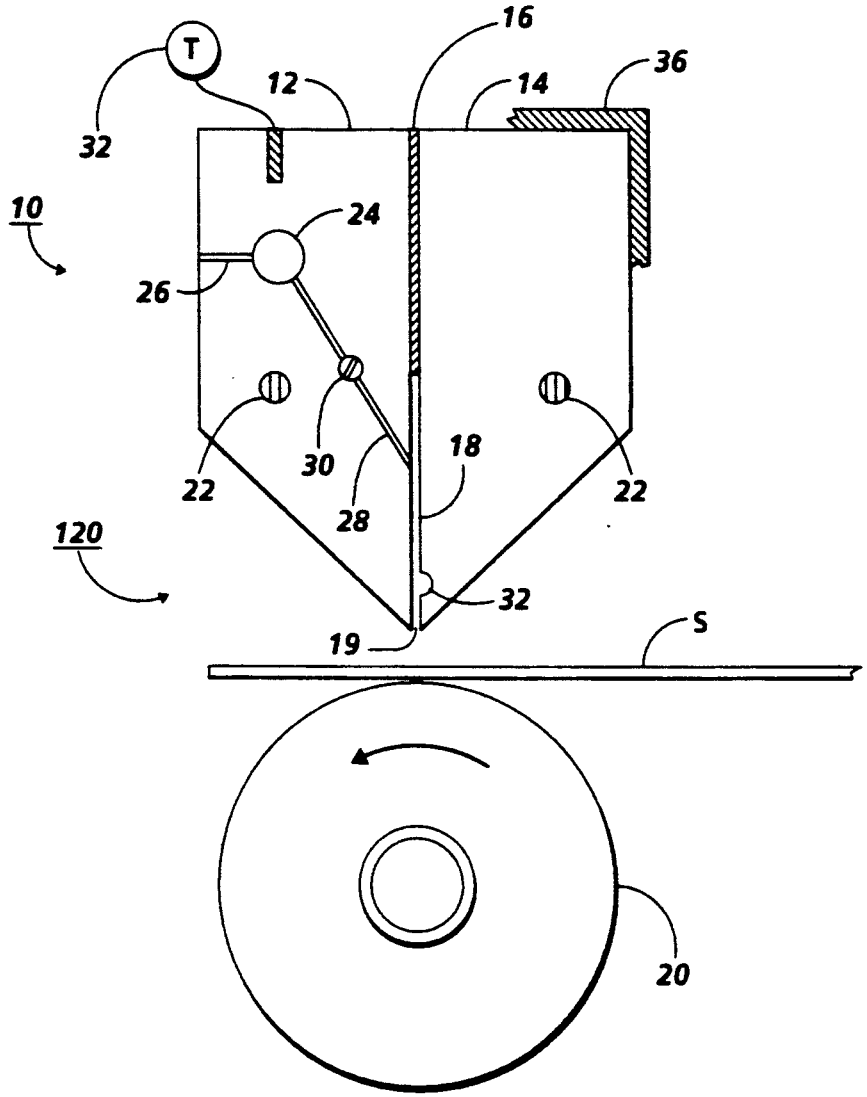
FIG. 2 is a cross-sectional view of a fuser according to the present invention.

FIG. 2 is a detailed cross-sectional view of a fusing station 120 according to the present invention. The purpose of fusing station 120 is to apply a "knife" of water vapor, generally speaking at 100° C., onto the unfused toner on a sheet coming off the photoreceptor. In the embodiment shown, the main part of the fusing station 120 is a flash-boiler generally indicated as 10. The flash-boiler 10 preferably comprises a first aluminum block 12 abutting a second aluminum block 14, the common surface of the two blocks 12, 14 being separated in the most part by a thin shim 16. In the preferred embodiment, shim 16 is a gasket made of a polyimide film of a thickness of approximately 3 mils. The shim 16 is disposed between only a portion of the common surface of blocks 12, 14, and the remaining gap between the blocks 12, 14, toward the bottom of the flash-boiler 10 in FIG. 2, creates a central channel 18. This central channel 18 will be of generally the same width as the shim 16, which is 3 mils. In FIG. 2, the flash-boiler 10 is shown in cross-section in a direction perpendicular to the path of a sheet S as it passes through the fuser 120. The flash-boiler 10 extends generally along the entire width of a sheet S, perpendicular to the path of the sheet S. As is clear from FIG. 2, the channel 18 forms a bottom slit 19 which is disposed adjacent the surface of sheet S, so as to apply water vapor onto the surface as the sheet S is moved past the flash boiler 10 by transport drum 20, which will be described in detail hereinbelow.

In order to create the knife of water vapor and apply it to the unfused toner on sheet S, the aluminum blocks 12, 14 are used to transfer heat to a controlled flow of liquid water entering into the flash-boiler 10. Heat may be created within the aluminum blocks 12, 14 by any commonly-known means for heating a metal member, although for use in a potentially commercially-available copying machine, an arrangement of resistive heating elements, or "cartridge heaters," is preferred. These elements are generally shown in cross-section as the cross-hatched areas 22 in FIG. 2, although the precise arrangement of these elements is generally not crucial. In use, these elements 22 should preferably heat the aluminum blocks 12, 14 to a temperature of 120°–130° C., which is sufficient to boil the flow of liquid water entering into the flash boiler 10.

One or both of the aluminum blocks 12, 14 preferably define an inner buffer cavity, here shown as cavity 24 in block 12. A metered and regulated flow of liquid water from an external source (not shown) is introduced into buffer cavity 24 through an input channel 26. The purpose of the buffer cavity 24 is not only to provide a relatively large "hot" surface area upon which liquid water may be applied for boiling, but also to provide a buffer to allow a relatively constant supply of water vapor to be produced. When liquid water is introduced through input channel 26 into buffer 24, the liquid water contacts the inner surface of the buffer cavity 24 which, as mentioned above, is preferably heated to 120°–130° C., at which point it rapidly boils. The water vapor is retained in the buffer cavity 24 until it is discharged through an output channel 28, which is controlled by a throttle 30.

The throttle 30 shown in FIG. 2 is of a rotatable stop-cock type, having a selectably movable cross-channel to complete the connection of output channel 28. Of course, any other type of electro-mechanically actuable device for opening and closing the output channel 28 apparent to one skilled in the relevant art would be acceptable. The output channel 28 communicates with the gap 18 between aluminum blocks 12, 14, and which forms the slit 19 adjacent the surface of a sheet S to be fused. As shown in FIG. 2, only the gap 18 need be continuously extending across the entire length of a sheet S; the input channel 26 and output channel 28 need not extend continuously across the flash-boiler 10, but may communicate in any way with the buffer cavity 24 and gap 18. The buffer cavity 24 need not be of any particular shape, although it is most simple to manufacture a long-cylindrical-shaped cavity, which may be created by drilling a long hole through aluminum block 12 and plugging the ends. A plurality of buffer cavities may be incorporated in a single flash-boiler. In addition, the cross-sectional arrangement of channels 26 and 28 need not be exactly like that shown in FIG. 2, but any arrangement making the necessary connections between a water source, buffer cavity 24, and gap 18 will be suitable. A part of channel 28, for example, may be defined by notches or openings in the shim 16 communicating with the gap 18.

The flash-boiler 10 should be designed so that all parts, including the throttle 30 and the channels 26, 28 are in good thermal contact with the main body so that water, once introduced, cannot touch any cool surface until it exits to the sheet S. The thickness of the polyimide shim 16 conveniently maintains the tolerances of the gap 18 when aluminum blocks 12, 14 are urged together.

The buffer cavity 24 is necessary because the smallest easily dispensable amount of liquid water which may be introduced through channel 26 is a single drop. Without the buffer cavity 24, the flash-boiler 10 would emit vapor in isolated puffs corresponding to the arrival of single drops on hot surfaces. The volume of the cavity 24 is sized so that the pressure out of a flash-boiler 10 will vary by no more than 10 percent as each drop is added. This has been found to be sufficiently smooth for an effective application of vapor onto the surface of the sheet S. A preferred volume of the buffer cavity 24 is 0.27 liters. The internal pressure in the flash-boiler is usually around 30 psi. The maximum possible temperature of the flash-boiler 10 is 200° C., determined by the temperature limits on the polyimide shim 16.

The flash boiler 10 preferably also has defined therein a cross-channel 32 adjacent the opening of the gap 18 and extending across the entire length of the flash-boiler 10, which serves to equalize the output pressure along the entire length of the flash-boiler 10. This cross-channel may be defined in one or both of the blocks 12, 14.

The temperature of the aluminum blocks 12, 14 may be regulated, by known means, using a temperature monitoring system generally indicated by 34. Further, in the interest of thermal efficiency, the flash-boiler 10 may be enveloped by an insulating material 36.

In operation, the flash-boiler 10 accepts a flow of liquid water from a source (not shown) through input channel 26 and into buffer cavity 24, where contact of the liquid water with the heated body of the flash-boiler 10 causes the liquid water to vaporize. The water vapor is retained in the buffer cavity 24 until a sheet S having toner thereon to be fused is introduced and begins to move adjacent the slit 19 of the gap 18, generally moved by the motion of transport drum 20. The presence of a sheet S having toner thereon to be fused, may be detected by any known means, such as an electric eye or a mechanical trip (not shown). When a sheet S is detected, throttle 30 is actuated to complete the output channel 28, thus allowing the pressurized water vapor in buffer cavity 24 to pass through the channel 28 to gap 18. The vapor pressure along the slit 19 of flash-boiler 10 is equalized by cross-channel 32, and a knife of water vapor is produced at opening 19.

It has been found that advantageous parameters for a practical embodiment of the present invention include: a width of slit 19 of approximately 3 mils, and a uniform gap between slit 19 and the surface of the sheet S of about 40 mils. With the preferred toner materials described below, the sheet S may move past the slit 19 at a process speed of 10 inches per second, which is generally acceptable relative to xerographic printers currently available. At such a speed, the dwell time of exposure of a portion of sheet S to the knife of water vapor is approximately 1 millisecond; because of the spreading of the water vapor on the surface of the sheet, the zone of exposure is somewhat wider than the width of the slit 19. As for water consumption, the fuser of the preferred embodiment would be capable of running a full eight-hour shift, fusing an eleven-inch copy sheet moving at ten inches per second, with a supply of about four liters of water. With the above parameters, a typical exit velocity of vapor being emitted from slit 19 is in the range of 50–100 cm/sec; this range of velocities suggests that high pressures and heavy structures are not needed. On the whole, the power and other requirements of the technique of the present invention are within practical limits.

The technique of fusing and fixing toner onto a sheet contemplated in the present invention is not necessarily a species of "vapor fusing" known in the prior art. The phrase "vapor fusing" familiar in the art relates to techniques in which toner material is soluble in a liquid whose vapor is permitted to surround the unfused toner and dissolve the toner in a chemical sense. The present invention, however, is intended to fuse the toner thermally, by releasing heat to the surface of the sheet by condensation of the applied water vapor. The present invention should also be distinguished from thermal fusing with a knife of hot air or other common gas. It has been found that applying a knife of air for thermal fusing creates a "boundary layer" of turbulence against the surface of the sheet; before the toner is fused it is blown off the paper. A condensable heat transfer gas, however, cannot form an insulating boundary layer; whenever it touches a cool surface, it collapses into the surface by condensation, delivering a large latent heat.

In order to effect this thermal fusing by condensation of water vapor, a "low-melt" toner material is necessary. Toner materials commonly used with conventional fusers, which typically comprise an amorphous polymer such as styrene co n-butyl methacrylate pigmented with carbon black, do not fuse (i.e., become fluid) at a sufficiently low temperature to be suitable for the method of fusing of the present invention. A suitable toner material must be fusible at 100° C., while still maintaining the requisite properties (of image permanence, for example) for commercial xerographic equipment.

The applicants have found that the best toner material known to them as of the filing hereof is docosanoic acid, also known as behenic acid. A toner which may be satisfactorily used with the fusing apparatus of the present invention should preferably substantially comprise this substance. Docosanoic acid is a long paraffin having a carboxylic acid end, with the formula $$CH_3(CH_2)_{20}COOH.$$

This substance has been found to be most effective for thermal fusing using condensation of water vapor. One commercially-available industrial-grade material which may be used as such a toner material is sold under the trade name HYSTRENE 9022.

Other low-melt toners are known, and among these are polyester-based resins, such as such as those disclosed, by way of example and not of limitation, in U.S. Pat. Nos. 4,849,495 to Funato et al. and 5,004,664 to Fuller et al. In order to be fusible at 100° C., however, these toners tend to have unsatisfactory "blocking" properties; that is, they tend to congeal into lumps before or during application to a copy sheet. Another substance which has been reasonably satisfactory as a toner material is a polymer called polyethoxazoline; however, this polymer is water-soluble, and at least a portion of the fusing properties of this material is due to solubility (in a conventional chemical vapor-fusing sense) in addition to the thermal aspect.

On the whole, it has been found that the most successful toner materials for use with the present invention are known as "waxy" toners. Selection of a waxy toner material must be judicious, because of the common problem known as "impaction." Briefly, impaction results when the waxy toner smears on the carrier bead particles, thus masking a large proportion of the surface area of each carrier bead. This masking, in turn, inhibits the necessary triboelectric properties which cause toner particles to transfer from the carrier beads to the photoreceptor.

Figure 3:
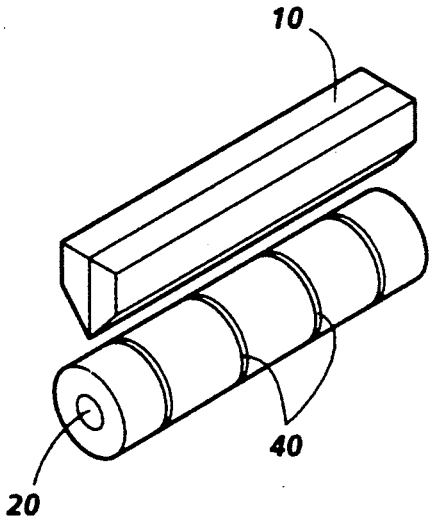
FIG. 3 is a simplified elevational view showing the fuser of the present invention in the context of a paper-handling device.

FIG. 3 is a simplified elevational view of the exterior of a flash boiler 10 in use with a transport drum 20. In order to ensure proper distribution of water vapor from flash boiler 19 to the surface of a copy sheet S, it has been found that a crucial parameter is uniformity of the gap between the slit 19 of gap 18 and the surface of the copy sheet S. An uneven distribution of the heat from the water vapor across the slit 19 is likely to result in noticeable quality problems with documents. One preferred technique for maintaining a uniform gap between the slit 19 and the surface of the copy sheet S is to provide a transport drum 20 with vacuum means (not shown) for holding the opposite surface of the sheet S against the transport drum as the relevant portion of the sheet S passes adjacent the slit 19. One vacuum system known in the art includes a set of parallel grooves 40 along circumferences of the transport drum 20 through which the vacuum may be applied to grab the sheet S tightly against the drum.

Figure 4:
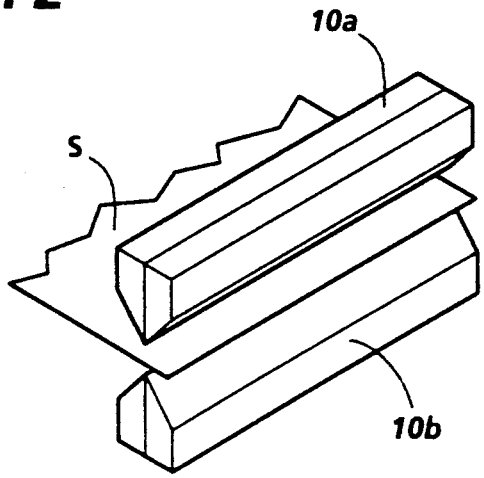
FIG. 4 is a simplified elevational view of an alternate embodiment of the present invention.

An important problem that results when using the flash boiler 10 of the present invention is paper curl. As is well known, most types of paper distort greatly when permeated with moisture and exposure to a knife of water vapor to one side of a sheet of paper will cause that one side to shrink considerably relative to the other side, causing severe paper curl. In order to rectify this problem, a preferred technique is to apply different knives of water vapor to both sides of a sheet S simultaneously, so that the equalization of moisture on both sides of the sheet will prevent paper curl. Such an arrangement is shown by the elevational view of FIG. 4, wherein two flash boilers, 10*a* and 10*b*, apply water vapor to both sides of the sheet S simultaneously, even though only one side may have toner thereon. A transport arrangement of rollers to accommodate these two flash boilers would be apparent to one skilled in the relevant art. However, it must be admitted that copies fused by this method exhibit a slight waviness. U.S. Pat. No. 4,922,304 to Gilbert et al. discloses a fuser belt, for use with a heated drum, which allows for the escape of excess water vapor from a copy sheet.

Despite the problems of low fusing temperature and paper curl, the method of the present invention provides numerous advantages over various prior art fusing techniques. It has been found that many of the parameters for carrying out the method of the invention are well within practical constraints, and many of these parameters compare favorably with other commercially available fusing methods. Although a machine incorporating the present invention would require the novelty of a water supply, relatively little water is needed per copy. It is a reasonable estimate that the mass of water required to fuse a copy is approximately 100 milligrams, which is just twice the mass of toner commonly found on a copy sheet. This small amount of water translates into a relatively small effect on paper, excluding the concerns with curl mentioned above. Office bond paper weighs about 75 grams per square meter, and, at 50% relative humidity contains about 8% by weight of moisture. Thus, the added water per copy caused by each flash boiler adds only about 2% of the paper mass to the paper, and increases the water already present in the paper by only about 20%. Such an increase in moisture can be reasonably scavenged by most types of bond paper, without serious changes in the mechanical properties of the paper. Further, water added to the paper will probably not appear in the environment.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

We claim:

1. In a xerographic printing apparatus, a method of fusing toner material onto a surface of a copy sheet, comprising the step of delivering heat to the toner material by condensing water vapor on the surface of the copy sheet.

2. A method as in claim 1, wherein the toner material substantially comprises a material which is fusible at the boiling temperature of water.

3. A method as in claim 2, wherein the toner material substantially comprises docasanoic acid.

4. A method as in claim 1, wherein water vapor is condensed on the surface of the copy sheet by means of applying the water vapor onto the surface through means defining a narrow slit, the narrow slit moving relative to the surface.

5. A method as in claim 4, wherein the slit is spaced between 0.03 and 0.09 inches from the surface of the copy sheet.

6. A method as in claim 4, wherein the dwell time of an area of the surface adjacent the slit is between 0.5 and 1.5 milliseconds.

7. In a xerographic printing apparatus, a device for fusing toner material and fixing the toner material onto a surface of a copy sheet, comprising:

means for supporting the copy sheet;

means defining a slit, the slit defining a width and a long length, the slit disposed adjacent the surface of the copy sheet opposite the means for supporting the copy sheet;

means for causing the copy sheet to move relative to the slit in a direction substantially perpendicular to the long length of the slit; and means for causing water vapor to pass through the slit toward the surface of the copy sheet opposite the means for supporting the copy sheet.

8. A device as in claim 7, wherein the means for defining a slit further defines a cross-channel disposed adjacent the slit along the long length of the slit.

9. A device as in claim 7, wherein the means for defining a slit includes first and second blocks, a shim disposed between the first and second blocks, the shim substantially contacting a portion of the outer surfaces of the first and second blocks, whereby the slit is defined in the space between the first and second blocks adjacent the shim.

10. A device as in claim 9, further comprising:

means for generating water vapor; and channel means defined in at least one of the first and second blocks, the channel means communicating from the means for generating water vapor to the slit.

11. A device as in claim 10, wherein the means for generating water vapor includes means defining a buffer chamber in at least one of the first and second blocks, the buffer chamber being in communication with the slit;

means for providing a supply of liquid water to the buffer chamber; and means for providing thermal energy to the buffer chamber.

12. A device as in claim 7, wherein the width of the slit is between 0.001 and 0.005 inches.

13. A device as in claim 7, wherein the slit is disposed between 0.03 and 0.09 inches from the surface of the copy sheet.

14. A device as in claim 7, wherein the width of the slit is between 0.001 and 0.005 inches and the slit is disposed between 0.03 and 0.09 inches from the surface of the copy sheet.

15. A device as in claim 7, further including vacuum means for maintaining a uniform gap between the slit and the surface of the copy sheet.

16. In a xerographic printing apparatus, a device for fusing toner material and fixing the toner material onto a surface of a copy sheet, comprising:

means for supporting the copy sheet;

first and second means each defining a slit, each slit defining a width and a long length, the slits disposed adjacent opposite surfaces of the copy sheet;

means for causing the copy sheet to move relative to the slits in a direction substantially perpendicular to the long length of the slits; and means for causing water vapor to pass through the slits toward the surface of the copy sheet.

17. A device as in claim 16, wherein each means for defining a slit includes first and second blocks, a shim disposed between the first and second blocks, the shim substantially contacting a portion of the outer surfaces of the first and second blocks, whereby the slit is defined in the space between the first and second blocks adjacent the shim.

18. A device as in claim 17, further comprising means for generating water vapor and channel means defined in at least one of the first and second blocks of each means for defining a slit, the channel means communicating from the means for generating water vapor to the slit.

* * * * *